US006462672B1

(12) United States Patent
Besson

(10) Patent No.: US 6,462,672 B1
(45) Date of Patent: Oct. 8, 2002

(54) DATA ACQUISITION APPARATUS

(75) Inventor: Christian Besson, Newham (GB)

(73) Assignee: Schlumberger Technology Corporation, Ridgefield, CT (US)

( * ) Notice: Subject to any disclaimer, the term of this patent is extended or adjusted under 35 U.S.C. 154(b) by 0 days.

(21) Appl. No.: 09/372,520

(22) Filed: Aug. 11, 1999

(30) Foreign Application Priority Data

Aug. 15, 1998 (GB) ..... 9817732

(51) Int. Cl.[7] ..... G01V 3/00

(52) U.S. Cl. ..... 340/853.2; 340/853.7; 340/584.9

(58) Field of Search ..... 340/853.2, 853.7, 340/853.8, 584.9

(56) References Cited

U.S. PATENT DOCUMENTS

| | | | | |
|---|---|---|---|---|
| 5,160,925 A | | 11/1992 | Dailey et al. | |
| 5,410,303 A | | 4/1995 | Comeau et al. | |
| 5,531,270 A | | 7/1996 | Fletcher et al. | |
| 5,592,437 A | * | 1/1997 | Elliott | 367/21 |
| 5,602,541 A | | 2/1997 | Comeau et al. | |
| 5,706,896 A | | 1/1998 | Tubel et al. | |
| 5,721,538 A | | 2/1998 | Tubel et al. | |

FOREIGN PATENT DOCUMENTS

| | | |
|---|---|---|
| EP | 0 773 345 A1 | 5/1997 |
| GB | 2 210 087 A | 6/1989 |
| WO | 92/06278 A1 | 4/1992 |

OTHER PUBLICATIONS

BPO Fact Sheet on Contract FEW 2836.100 Contractor: Sandia National Lab Print–out from http://oil.bpo.gov/10120.html, No Page Numbers.

Schlumberger Geco–Prakla Digiseis–FLX, Radio Telemetry Acquisition System Published in 1995, No Page Number.

* cited by examiner

*Primary Examiner*—Timothy Edwards, Jr.
(74) *Attorney, Agent, or Firm*—William L. Wang; William B. Batzer; John J. Ryberg

(57) ABSTRACT

There is provided a data acquisition apparatus for use in a wellbore, having a receiver attached to an elongate electrical connector for conveying signals from downhole to surface, and a plurality of sensing devices adapted to be positioned downhole in spaced apart positions remote from the receiver, so as to form an array of sensing devices. The receiver includes a transmitter so as to allow two-way travel of signals within the wellbore. The invention is particularly of use when acquiring data in near-horizontal wells, or horizontal wells. Data acquired by one sensing device is transmitted to a receiver on a neighboring sensing device for transmittal from the neighboring sensing device to a next neighbour in the array. Data signals are thus relayed along the array of sensing devices until the last sensing device in the array transmits all acquired data to the receiver. The spacing between the individual sensing devices is regular and ranges from 3 meters to 100 meters. There is also provided a method of acquiring signals down a wellbore, comprising the steps of placing a plurality of spaced apart sensing devices within a lower part of the wellbore in the form of an array, and transmitting data acquired by each sensing device to a next one in the array by wireless telemetry.

22 Claims, 2 Drawing Sheets

DATA ACQUISITION APPARATUS

Figure 1:
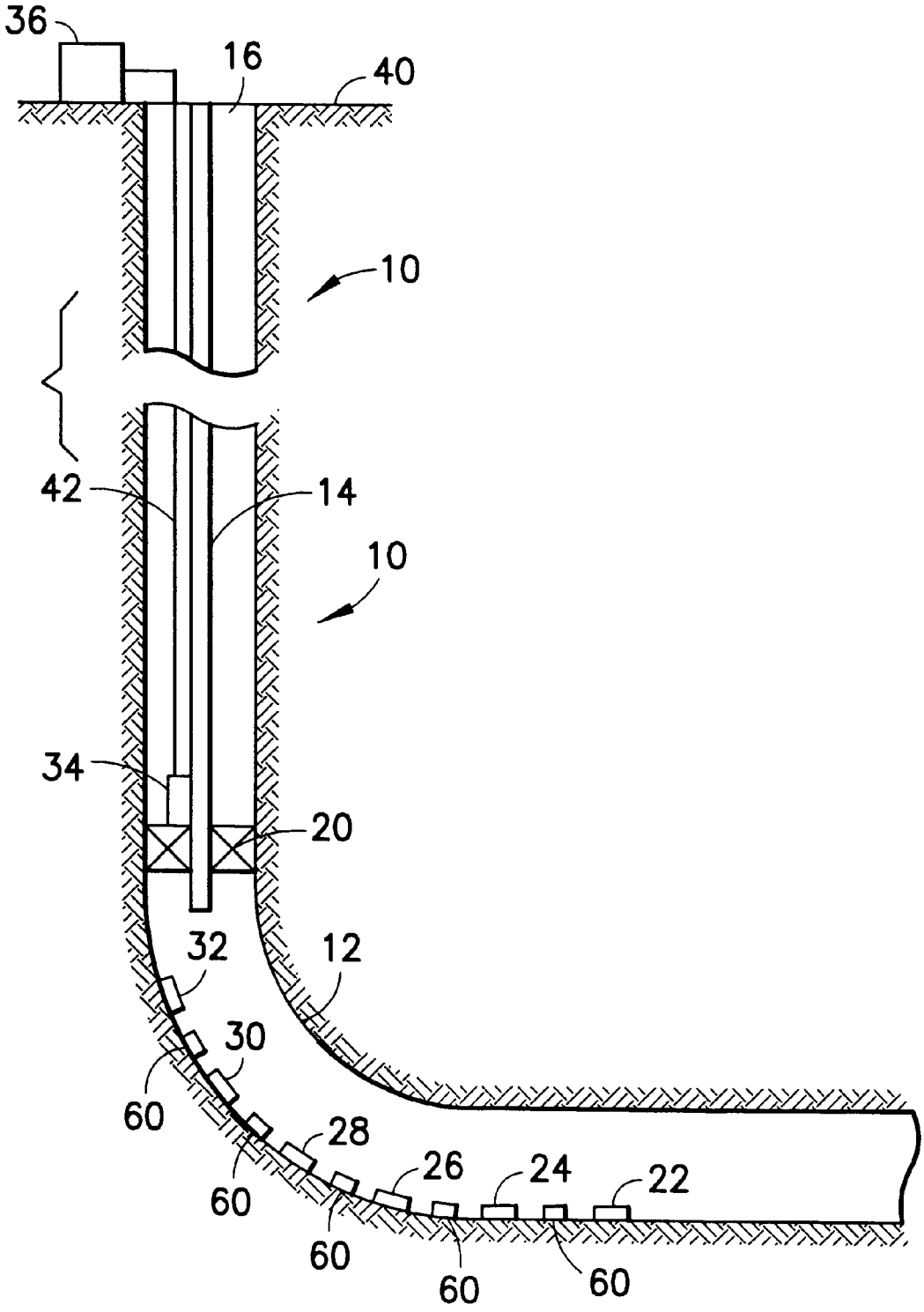

This invention relates to data acquisition apparatus for use in a wellbore and a method of acquiring signals down a wellbore.

BACKGROUND OF THE INVENTION

Data acquisition apparatus, including sensors, is often provided in a wellbore to monitor the movement of fluid within a fluid producing reservoir or movement of fluid within the wellbore itself. In a wellbore with casing and tubing in place, sensors are typically placed behind the tubing, so as to be in an annulus between tubing and casing, and the sensors are connected to the surface by a cable positioned in the annulus. The cable provides both power and telemetry to the sensors. It has been attempted to deploy the sensors behind casing, connecting the sensors to the surface by a cable which passes through the cement holding the casing in contact with the outer wall of the wellbore. However problems have arisen with such techniques due to the difficulties of protecting the cable during installation, and ensuring that the quality of the cement is not affected by the presence of the cable, as otherwise zonal isolation cannot be maintained.

It has been proposed to avoid such problems by providing a wireless telemetry link from downhole to surface. However problems also arise with this approach in relation to signal attenuation and transmission range.

SUMMARY OF THE INVENTION

According to one aspect of the present invention, there is provided a data acquisition apparatus for use in a wellbore, comprising a receiving means attached to an elongate electrical connector for conveying signals from downhole to surface, and a plurality of sensing devices adapted to be positioned downhole in spaced apart positions remote from the receiving means, so as to form an array of sensing devices.

Typically the electrical elongate connector is a cable attached to a surface processing unit which can both receive and transmit signals along the connector.

Preferably the receiving means includes a transmitter so as to allow two-way travel of signals within the wellbore. Thus both uphole and downhole transmission of signals is enabled, allowing acquired data to be forwarded uphole and command signals from the surface to be sent downhole to the sensing devices via the receiving means.

The present invention is particularly of use when acquiring data in near-horizontal wells, or horizontal wells, and in such situations the receiving means is preferably located within the vertical part of the wellbore, with the sensing devices adapted to be positioned along the near horizontal or horizontal portion of the wellbore. The use of a receiving means with an electrical connection to surface to carry signals over the vertical section of the wellbore substantially reduces the number of spaced sensing devices required to transmit the signal from downhole to surface over the number required for pure wireless telemetry along the entire length of the wellbore.

Preferably each sensing device has at least one sensor, a transmitter and a receiver. This allows data acquired by one sensor to be transmitted to a receiver on a neighbouring sensing device for transmittal from the neighbouring sensing device to the next neighbour, et seq. Data signals thus may be relayed along the array of sensing devices until the last sensing device in the array transmits all acquired data to the receiving means.

Each sensing device may include a plurality of sensors so that data relating to different parameters, such as temperature, pressure, resistivity, and fluid flow, can be acquired.

Each sensing device may be provided with a processing unit to allow signals received from a sensing device further down the array to be combined with its own signal, so as to produce a combined signal for onward transmission to the next sensing device in the array.

Preferably each sensing device is provided with first and second transceivers, the first transceiver receiving a signal from a first neighbouring sensing device in the array, and the second transceiver transmitting the combined signal to a second neighbouring sensing device in the array.

In some arrangements, the sensing devices may be able to move within the wellbore, and to this end may be in the form of robot-like entities.

In other arrangements, the sensing devices may be permanently fixed in position within the wellbore, typically by incorporating the sensing devices into casing, either internally or externally. With such permanent positioning, the sensing devices require a downhole power supply, which may be provided for example by means of batteries. However the power available downhole will be limited compared to that which would be available with a power connection to surface, and therefore the transmission range of the transceivers associated with the sensing devices will be limited as compared with sensing devices which can be powered from the surface. Boosters may be provided between the sensing devices to ensure that each device is within range of its nearest neighbour or preferably sensing devices may be spaced at intervals along the well such that the distance between each sensing device and its nearest neighbour is not greater than the transmission range.

Thus at the limit of operation, without boosters, each sensing device is spaced apart from its near neighbour by a distance equal to the transmission range. Desirably at least two sensing devices are provided within a distance equal to the transmission range. While this increases the number of sensing devices required downhole, it ensures that a failure of one sensing device does not prevent onward transmission along the array. Thus multiple sensing devices may be provided within the distance equal to the transmission range, and as a preferred example four sensing devices may be provided.

Typically the spacing between the individual sensing devices may range from 3 meters to 100 meters.

According to another aspect of the invention, there is provided a method of acquiring signals down a wellbore, comprising the steps of placing a plurality of spaced apart sensing devices within a lower part of the wellbore so as to form an array, and transmitting data acquired by each sensing device to a next one in the array by wireless telemetry, so as to relay data along the array.

The use of such a relay technique avoids the need for the sensing devices to have a large power output and consequential large power requirement which would be difficult to support where the sensing devices are autonomous and connection to a surface power supply is not desirable or not possible.

The expression "wireless telemetry" is intended to include any form of wireless communication, for example using acoustic transmission or electromagnetic waves.

Preferably the method also comprises placing a receiving means attached to an elongate electrical connector within an upper part of the wellbore, and one of the sensing devices of the array transmits data to the receiving means.

These and other features of the invention, preferred embodiments and variants thereof, possible applications and advantages will become appreciated and understood by those skilled in the art from the detailed description and drawings following below.

DRAWING

Figure 2:
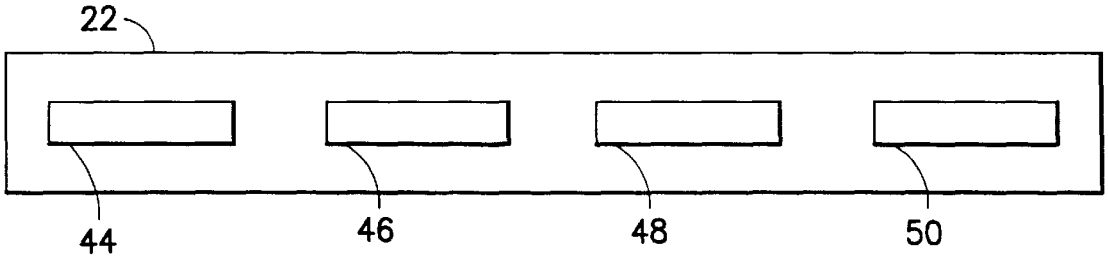

FIG. 1 is a schematic diagram of data acquisition apparatus, including sensing devices, in accordance with the invention when in use; and FIG. 2 shows a schematic diagram of the sensing device.

DETAILED DESCRIPTION

In FIG. 1, a wellbore 10 is shown in cross-section, with casing 12 cemented in position about the diameter of the wellbore 10 and production tubing 14 placed within a channel defined by the casing 12. Annulus 16 is formed between the casing 12 and tubing 14, and is isolated from fluid further down the wellbore 10 by a packer 20. Sensing units 22, 24, 26, 28, 30, 32 are attached to the inner surface of casing 12 along the substantially horizontal part of the wellbore 10 and are spaced apart at discrete intervals so as to form an array. A master unit 34 is positioned towards the downhole end of the vertical section of the wellbore 10, at the tubing shoe, and is situated just above packer 20 within annulus 16. The master unit 34 is connected to a receiving and processing unit 36 on surface 40 by an electrically conductive cable 42.

Each sensing unit comprises a first transceiver 44, a processing unit 46, a second transceiver 48 and sensors 50, as shown for sensing unit 22 in FIG. 2. The sensors 50 detect various parameters downhole, such as pressure, temperature, flow rate of fluid within the borehole, and resistivity. The transceivers 44, 48 vibrate to produce an acoustic signal for transmission of data and are receptive to acoustic signals in the wellbore to receive data.

The sensing units 22, 24, 26, 28, 30, 32 are deployed downhole by attaching them to the casing 12. As the wellbore 10 is drilled deeper, sections of casing 12 are cemented in position and when in the lower horizontal part of the well, some of the joints of casing fed down the hole have a sensing unit attached to them. A number of sensing units are fed down the hole in this way to form the array of units 22, 24, 26, 28, 30, 32 shown in FIG. 1, with no direct connection to the surface 40. The spacing of the units in the array is achieved by interspersing joints of casing having sensing units attached with joints of casing without sensing units. Each sensing unit is autonomous, having its own power supply, such as a battery, and because of this has a limited transmission range due to the limited power available to each sensing unit from its associated batteries. In the array of sensing units spaced regularly along the horizontal portion of the well, the distance between each sensing unit and its nearest neighbour is within the transmission range of the wireless telemetry used by the transceivers 44, 48 to communicate between the units. The sensing units are spaced 50 meters apart, with the sensing unit 32 closest to the heel of the well being within transmission range of master unit 34. According to one embodiment, boosters 60 are provided between the sensing units 22, 24, 26, 28, 30, and 32 to ensure that each device is within range of its nearest neighbour.

After the wellbore has been lined with casing 12, and the sensing units 22, 24, 26, 28, 30, 32 are positioned, the master unit 34 is attached to the outside of the tubing 14 and cable 42. The production tubing 14 and packer 20 are urged downhole from surface and as the tubing 14 passes further downhole, the master unit 34 and cable 42 follow until the master unit 34 is in the required downhole position. Cable 42 provides master unit 34 with both a power supply and direct communication with the surface receiving and processing unit 36. Both the master unit 34 and the sensing units 22, 24, 26, 28, 30, 32 are permanent and are not intended to be removed once downhole.

The master unit 34 is essentially the same device as the sensing units, although with a hardwired connection to the surface via cable 42.

The use of the data acquisition apparatus is as follows:

Data relating to the conditions within the wellbore 10 is acquired in each sensing unit by the sensors 50 and is passed to transceiver 48, which forwards the data signal to processing unit 46.

Processed signals from the processing unit 46 are then passed to transceiver 44 which produces a vibratory signal in response to the processed data, so producing acoustic (sound) waves which travel through the casing 12 and the fluid in the wellbore.

At the sensing unit 22 furthest down the wellbore, at the lower end of the array, the acquired data signal from sensors 50 is simply passed through the processing unit 46 and onwardly transmitted as an acoustic signal to the next receiver in the array by its transceiver 44. The transceiver 48 of the neighbouring unit 24 detects the acoustic signal from the earlier unit 22 and passes the received signal and the locally acquired signal from its own sensors 50 to its processing unit 46 where the received data signal and the locally acquired signal are combined. The combined signal is then passed to transceiver 44 which transmits the combined signal to the next sensing unit 26 in the array. In this way data is relayed along the array in a "bucket brigade" mode, data being acquired by each sensing unit and added to the data acquired by units lower in the array before onward transmission. This continues along the array until the sensing unit 32 highest in the wellbore at the upper end of the array transmits the total combined data from all the sensing units to the master unit 34, by acoustic transmission through the casing 12 and the tubing 14.

In this way information from the sensor units where the master unit 34 is outside their transmission range, can still be forwarded to the master unit by relaying the signal along the array. So data is transmitted from the bottom of the well (the toe of the well) to the top of the well (the heel of the well), each sensing unit relaying its own acquired data together with the data acquired by sensing units situated below it to the next higher sensing unit in the array. Transmission protocols for such bucket brigade telemetry are known, for example in the D4 transmission zone seismic acquisition system marketed by Geco-Prakla, where radio transmission is used in such a fashion. The data received by the master unit 34 is transmitted by telemetry along cable 32 to surface 40 for processing by surface unit 36 to identify the individual sensor readings within the combined signal.

Where commands are sent downhole from the surface unit 36, these are sent by telemetry along cable 42 to the master unit 34. The unit 34 then transmits the commands via wireless telemetry to the first sensing unit 32 at the upper end of the array. Transceiver 44 receives the command and passes it to processing unit 46 to be decoded for use in the receiving sensing unit 32 and also for onward transmission down the array to sensing unit 30.

What is claimed is:

1. An apparatus for acquiring data signals in a wellbore, comprising:

a receiver attached to an elongate electrical connector for conveying signals between a downhole location and the surface; and a plurality of sensing devices adapted to be positioned downhole in spaced apart positions from the receiver, so as to form an array of sensing devices, wherein at least one of the sensing devices is provided with a processing unit to allow signals received from a second sensing device in the array to be combined with its own signal, and so as to produce a combined signal for onward transmission to a third sensing device in the array.

2. An apparatus according to claim 1, wherein the receiver includes a transmitter so as to allow two-way travel of signals within the wellbore.

3. An apparatus according to claim 2, wherein the receiver is located within the vertical part of the wellbore, with the sensing devices adapted to be positioned along the near horizontal or horizontal portion of the wellbore.

4. An apparatus according to claim 2, wherein each sensing device has at least one sensor, a transmitter and a receiver.

5. An apparatus according to claim 4, wherein each sensing device includes a plurality of sensors.

6. An apparatus according to claim 1, wherein each sensing device is provided with a processing unit to allow signals received from a sensing device further down the array to be combined with its own signal, and so as to produce a combined signal for onward transmission to the next sensing device in the array.

7. An apparatus according to claim 1, wherein each sensing device is provided with first and second transceivers, the first transceiver to receive a signal from a first neighbouring sensing device in the array, and the second transceiver to transmit the combined signal to a second neighbouring sensing device in the array.

8. An apparatus according to claim 1, wherein the sensing devices are able to move within the wellbore.

9. An apparatus according to claim 1, wherein the sensing devices are permanently fixed in position within the wellbore.

10. An apparatus according to claim 1, wherein the sensing devices are provided with a downhole power supply.

11. An apparatus according to claim 10, wherein boosters are provided between the sensing devices to ensure that each device is within transmission range of its nearest neighbour.

12. An apparatus according to claim 10, wherein the sensing devices are spaced at intervals along the well, such that the distance between each sensing device and its nearest neighbour is not greater than the transmitter transmission range.

13. An apparatus according to claim 12, wherein at least two sensing devices are provided within a distance equal to the transmission range of the transmitter.

14. An apparatus according to claim 12, wherein multiple sensing devices are provided within a distance equal to the transmission range.

15. An apparatus for acquiring data signals in a wellbore, comprising:

a receiver attached to an elongate electrical connector for conveying signals between a downhole location and the surface; and a plurality of sensing devices adapted to be positioned downhole in spaced apart positions remote from the receiver, so as to form an array of sensing devices, wherein at least some of the plurality of sensing devices are each provided with a processing unit to allow signals received from a sensing device further down the array to be combined with its own signal, and so as to produce a combined signal for onward transmission to the another sensing device in the array, and wherein at least one sensing device includes a transmitter for transmitting a signal to the receiver.

16. A method of acquiring signals in a wellbore, comprising the steps of:

placing a plurality of spaced apart sensing devices within a lower part of the wellbore so as to form an array;

receiving with a first sensing device signals from a second sensing device in the array;

combining within the first sensing device the received signals from the second sensing device with signals from the first sensing device to form a combined signal; and transmitting the combined signal to a third sensing device in the array.

17. A method according to claim 16, further comprising:

placing a receiver attached to an elongate electrical connector within an upper part of the wellbore; and transmitting data to the receiver from one of the sensing devices of the array.

18. A method according to claim 16, wherein the sensing devices are provided with a downhole power supply.

19. A method according to claim 18, further comprising the step of placing boosters between the sensing devices to ensure that each device is within transmission range of its nearest neighbour.

20. A method according to claim 18, wherein the sensing devices are spaced at intervals along the well to ensure that each device is within transmission range of its nearest neighbour.

21. A method according to claim 16 wherein the step of transmitting uses wireless telemetry.

22. An apparatus according to claim 1 wherein the at least one sensing device is adapted for wireless telemetry.

* * * * *